US009391384B2

(12) United States Patent
Kodama et al.

(10) Patent No.: US 9,391,384 B2
(45) Date of Patent: Jul. 12, 2016

(54) CONNECTOR CRIMPING TERMINAL

(71) Applicant: Yazaki Corporation, Tokyo (JP)

(72) Inventors: Shinji Kodama, Makinohara (JP); Takashi Muro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/363,845

(22) PCT Filed: Dec. 20, 2012

(86) PCT No.: PCT/JP2012/084009

§ 371 (c)(1),
(2) Date: Jun. 9, 2014

(87) PCT Pub. No.: WO2013/100116

PCT Pub. Date: Jul. 4, 2013

(65) Prior Publication Data

US 2014/0302729 A1 Oct. 9, 2014

(30) Foreign Application Priority Data

Dec. 26, 2011 (JP) ..... 2011-284265

(51) Int. Cl.
*H01R 4/10* (2006.01)
*H01R 13/03* (2006.01)
(Continued)

(52) U.S. Cl.
CPC ..... *H01R 13/03* (2013.01); *H01R 4/18* (2013.01); *H01R 4/62* (2013.01); *H01R 43/16* (2013.01)

(58) Field of Classification Search
CPC ..... H01R 4/18; H01R 4/62; H01R 4/185; H01R 4/188; H01R 4/26; H01R 4/184; H01R 43/16; H01R 43/048
USPC ..... 439/203, 877, 879, 876, 887
See application file for complete search history.

(56) References Cited

U.S. PATENT DOCUMENTS 6,113,441 A * 9/2000 Fukase et al. ..... 439/877
6,334,798 B1 1/2002 Ushijima et al.
(Continued)

FOREIGN PATENT DOCUMENTS

CN 101904061 A 12/2010
EP 2 224 556 A1 9/2010
(Continued)

OTHER PUBLICATIONS

International Search Report, dated Mar. 28, 2013, issued by the International Searching Authority in counterpart International Application No. PCT/JP2012/084009.
(Continued)

*Primary Examiner* — Hae Moon Hyeon
*Assistant Examiner* — Peter G Leigh
(74) *Attorney, Agent, or Firm* — Sughrue Mion, PLLC

(57) ABSTRACT

A terminal, comprises an electric wire connecting part having a core wire barrel part that crimps a core wire exposed in one end of an electric wire, the core wire being made of a first metal; wherein the electric wire connecting part is made of a second metal whose ionization tendency is lower than that of the first metal, wherein the electric wire connecting part is plated with a third metal whose ionization tendency is between the first metal and the second metal so that a plating layer made of the third metal is formed on the electric wire connecting part, and wherein the core wire barrel part is crimped so as to break down the plating layer formed on a connecting surface of the core wire barrel part on which the core wire is mounted.

4 Claims, 5 Drawing Sheets

(51) Int. Cl.

| | |
|---|---|
| ***H01R 4/62*** | (2006.01) |
| ***H01R 43/16*** | (2006.01) |
| ***H01R 4/18*** | (2006.01) |

(56) References Cited

U.S. PATENT DOCUMENTS

| | | | | |
|---|---|---|---|---|
| 6,942,529 | B2 * | 9/2005 | Fujimoto et al. | 439/886 |
| 8,245,396 | B2 * | 8/2012 | Kondo et al. | 29/863 |
| 2002/0028612 | A1 * | 3/2002 | Ushijima et al. | 439/879 |
| 2011/0045713 | A1 * | 2/2011 | Ono et al. | 439/877 |
| 2011/0225820 | A1 * | 9/2011 | Kondo et al. | 29/863 |
| 2012/0115375 | A1 * | 5/2012 | Kakuta | 439/877 |
| 2013/0072074 | A1 * | 3/2013 | Inoue et al. | 439/886 |
| 2013/0072075 | A1 * | 3/2013 | Kayamoto | 439/887 |
| 2013/0126236 | A1 * | 5/2013 | Suzuki et al. | 174/84 |
| 2013/0199842 | A1 * | 8/2013 | Inoue et al. | 174/84 C |

FOREIGN PATENT DOCUMENTS

| | | | |
|---|---|---|---|
| JP | 11-121075 | A | 4/1999 |
| JP | 2009-152052 | A | 7/2009 |
| JP | 2009-283288 | A | 12/2009 |
| JP | 2010-165514 | A | 7/2010 |

OTHER PUBLICATIONS

Written Opinion, dated Mar. 28, 2013, issued by the International Searching Authority in counterpart International Application No. PCT/JP2012/084009.

Communication dated Sep. 30, 2015 issued by Korean Intellectual Property Office in counterpart Korean Patent Application No. 10-2014-7017607.

Communication dated Sep. 30, 2015 issued by The State Intellectual Property Office of The People's Republic of China in counterpart Chinese Patent Application No. 201280064813.6.

Office Action dated Jul. 14, 2015, issued by the Japanese Patent Office in counterpart Japanese Application No. 2011-284265.

* cited by examiner

CONNECTOR CRIMPING TERMINAL

TECHNICAL FIELD

The present invention relates to a terminal in which a contact corrosion of dissimilar metals is prevented between a core wire and the terminal respectively made of the dissimilar metals.

BACKGROUND ART

A copper material or an aluminum material having an electric conductivity is usually used as a signal wire or a power line in the field of a motor vehicle. Particularly, since the copper material is excellent in its electric conductivity and high in its strength, the copper material is preferably used for a terminal or an electric wire. In an electric vehicle which is recently vigorously developed, since large energy needs to be taken out from a battery, the electric wire connected thereto requires a power line whose diameter is larger than that of a usual electric wire. On the other hand, when an improvement of efficiency for a fuel cost is considered due to a lightened vehicle, the total weight of the electric wire used for one motor vehicle cannot be treated lightly. Under these circumstances, an aluminum electric wire using in a core wire aluminum whose specific gravity is 2.70 g/cm$^3$ has been more used than copper whose specific gravity is 8.96 g/cm$^3$ as an electric wire mounted on a vehicle.

However, in a connecting part where a terminal made of the copper material is connected to a core wire made of the aluminum material, a contact corrosion of dissimilar metals (a galvanic corrosion) is concerned about. Since a standard electrode potential of copper in an electrochemical reaction is +0.34 V and a standard electrode potential of aluminum is −1.676 V, a standard electrode potential difference between them is as large as 2.00 V. Accordingly, when condensate or rain water enters and stays in the contact part of the two conductors, a battery is formed by aluminum, copper and aqueous electrolyte solution. Thus, the contact corrosion of the dissimilar metals is generated in the aluminum conductor as an anode of the battery.

Thus, in a terminal fitting disclosed in PTL 1, a corrosion preventing agent is applied to a contact part of an aluminum core wire and a terminal in the terminal made of copper alloy which attaches under pressure and connects an aluminum electric wire to prevent the corrosion between the electric wire and the terminal. Namely, a terminal fitting 501 shown in FIG. 5 includes an electric wire connecting part 505 on which an electric wire 503 is mounted and connected. In the electric wire 503, a core wire 507 made of a material different from a material of the terminal fitting 501 is coated with an insulating coat 509 and the core wire 507 is exposed in an en part thereof. In the electric wire connecting part 505, a core wire barrel piece 511 which attaches the core wire 507 under pressure and an insulating coat barrel piece 513 which attaches under pressure the insulating coat 509 are formed with a space provided between them. A part between the core wire barrel piece 511 and the insulating coat barrel piece 513 is set as a core wire arranging area 515 in which the core wire 507 of the electric wire 503 is arranged. On a surface of the core wire arranging area 515 and an end part arranging area 517 where the electric wire 503 is mounted, a corrosion preventing agent for preventing the corrosion of the core wire 507 is applied.

CITATION LIST

Patent Literature

[PTL 1] JP-A-2010-165514

SUMMARY OF INVENTION

Technical Problem

However, the usual terminal fitting 501 requires a process for applying the corrosion preventing agent after the terminal is manufactured, so that an operating process is increased. The corrosion preventing agent as an insulator needs to be masked so that the corrosion preventing agent is not spread to the core wire barrel piece 511 or a contact part. Thus, an operating process is further increased. Further, the corrosion preventing agent is not applied to the core wire barrel piece 511. Thus, corrosion due to an entry of water from an exposed part of a boundary of the core wire barrel piece 511 and the core wire 507 cannot be prevented.

The present invention is devised by considering the circumstances and it is an object of the present invention to provide a terminal which prevents a contact corrosion of dissimilar metals between a core wire and a terminal made of the dissimilar metals and simplifies an operating process more than an application of an insulator after a production.

Solution to Problem

The object of the present invention is achieved by below-described structures.

(1) A terminal, comprising:

an electric wire connecting part having a core wire barrel part that crimps a core wire exposed in one end of an electric wire, the core wire being made of a first metal;

wherein the electric wire connecting part is made of a second metal whose ionization tendency is lower than that of the first metal, wherein the electric wire connecting part is plated with a third metal whose ionization tendency is between the first metal and the second metal so that a plating layer made of the third metal is formed on the electric wire connecting part, and wherein the core wire barrel part is crimped so as to break down the plating layer formed on a connecting surface of the core wire barrel part on which the core wire is mounted.

In the terminal having the structure of the (1), since the plating layer (the third metal) which isolates both conductors from each other is interposed in an exposed part of a boundary of the core wire (the first metal) and the connecting surface (the second metal) of the electric wire connecting part which is formed when the core wire is crimped, a connecting state meeting an order of the level of the ionization tendency such as the first metal—the third metal—the second metal is formed in the exposed part of the boundary. Thus, even when aqueous electrolyte solution such as rain water enters and stays, the plating layer preferentially takes over a contact corrosion of dissimilar metals to prevent the core wire from being corroded. Further, since the plating layer on the connecting surface of the core wire barrel part is broken down during a crimping operation. Thus, the core wires can be assuredly electrically conducted to the connecting surface of the core wire barrel part. Accordingly, a process is not necessary for masking an insulator which increases a resistance value so as not to spread the insulator to the electric wire connecting part as in the usual structure. Thus, a range to which a plating process is applied is easily managed.

(2) In a terminal having the structure of the (1), an end part of the core wire barrel part in a longitudinal direction of the terminal is provided with a bell-mouth part.

In the terminal having the structure of the (2), in the plating layer of the connecting surface in the bell-mouth part, a deformation due to a crimping operation is smaller than a deformation in other crimped part. Thus, the plating layer in the bell-mouth part is not broken down and left during the crimping operation. Accordingly, the corrosion of the exposed part of the boundary is more assuredly prevented.

Advantageous Effects of Invention

According to the terminal of the present invention, a terminal can be prevented which prevents a contact corrosion of dissimilar metals between a core wire and a terminal made of the dissimilar metals and simplifies an operating process more than an application of an insulator after a production.

The present invention is briefly described as mentioned above. Further, when a mode for carrying out the present invention (refer it to as an "exemplary embodiment", hereinafter.) that will be described below is read by referring to the attached drawings, a detail of the present invention is more clarified.

DESCRIPTION OF EMBODIMENTS

Figure 1:
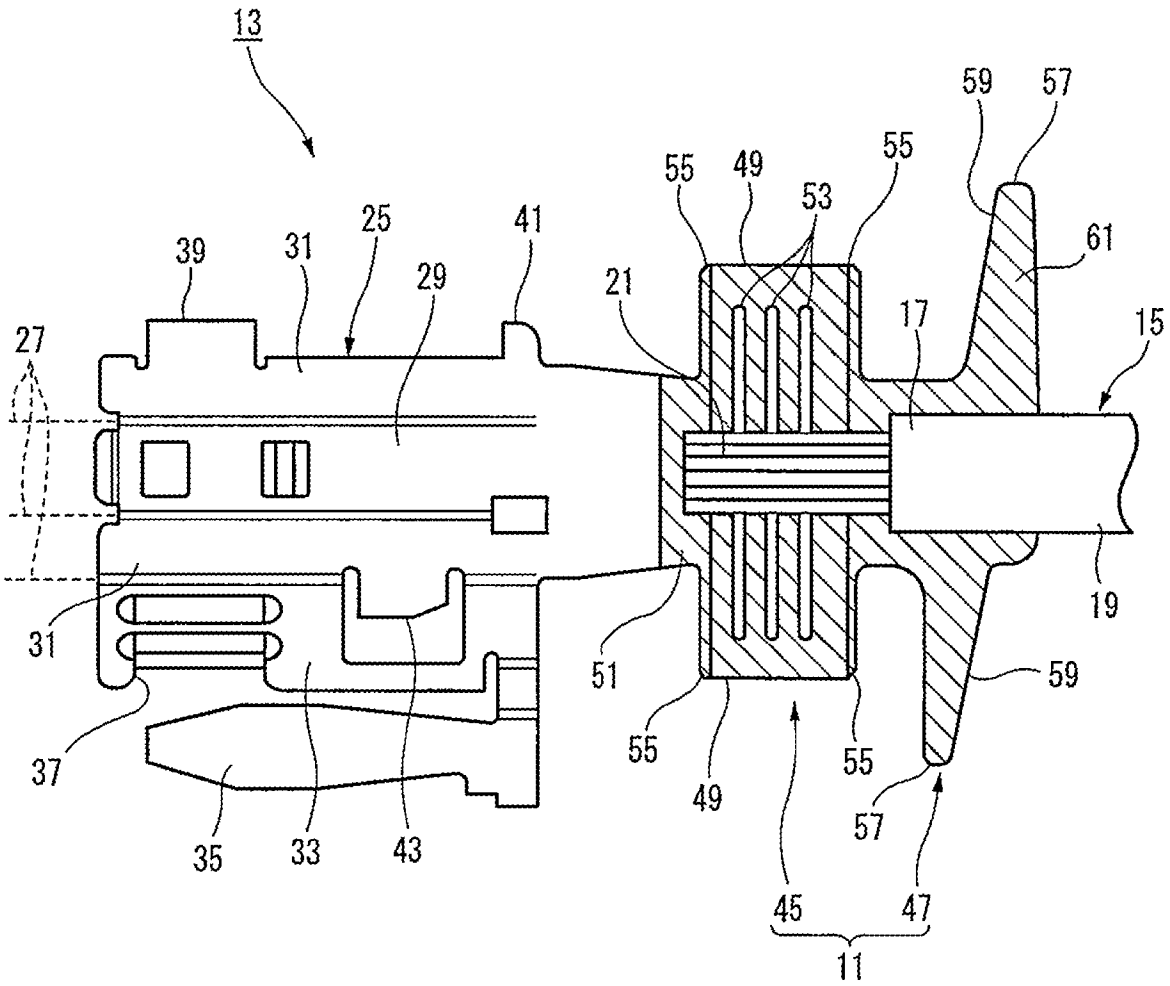
FIG. 1 is a plan view of an expanded state of a terminal according to one exemplary embodiment of the present invention shown together with an electric wire.

Now, an exemplary embodiment of the present invention will be described below by referring to the drawings.

Figure 2:
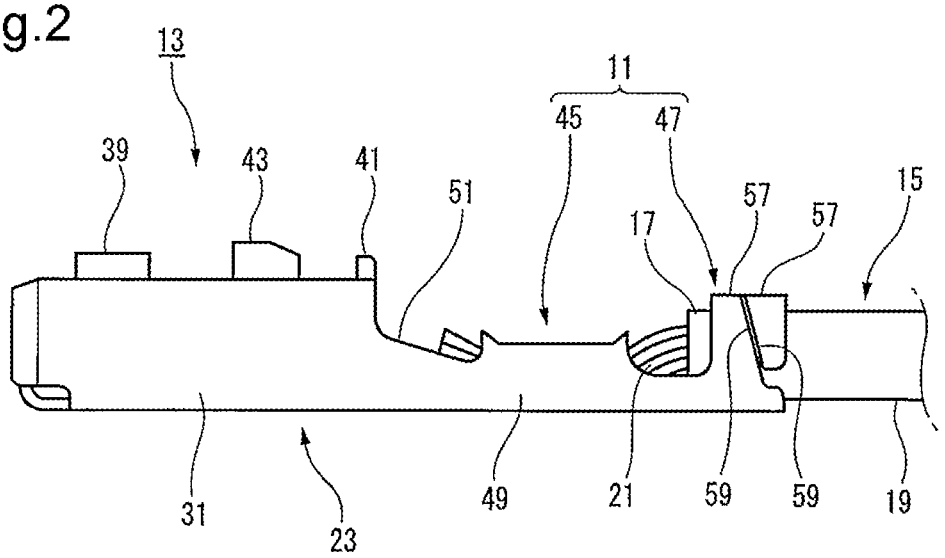
FIG. 2 is a side view showing a state that the electric wire is attached under pressure to the terminal shown in FIG. 1.
Figure 3:
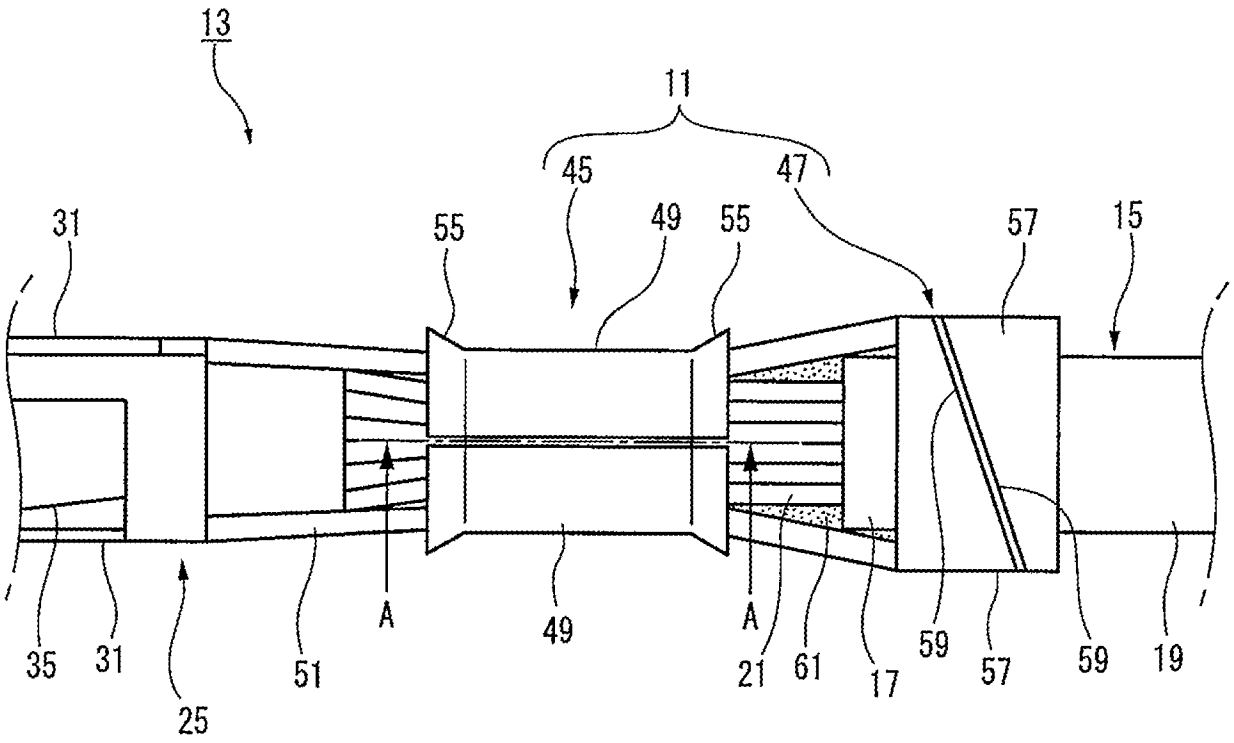
FIG. 3 is a plan view of main parts of FIG. 2.

As shown in FIGS. 1 to 3, a terminal 13 according to the present exemplary embodiment includes a terminal connecting part 23 fitted and connected to a mate terminal not shown in the drawing and an electric wire connecting part 11 crimped and connected to one end part of an electric wire 15. In the electric wire 15, an insulating coat 19 of one end 17 is peeled so that core wires 21 of an aluminum electric wire formed with an aluminum material (aluminum, aluminum alloy) as a first metal is exposed by a prescribed length. The electric wire 15 is connected to the electric wire connecting part 11 of the terminal 13 with the exposed core wires 21 directed toward a side of the terminal connecting part 23 of the terminal 13.

The terminal 13 including the terminal connecting part 23 is formed with a copper material (copper, brass, etc.) as a second metal (an ionization tendency is lower than the first metal) different from the first metal. In the terminal 13, the terminal connecting part 23 (see FIG. 2) is formed in the shape of a square tube by bending an expanded terminal fitting piece 25 along bending lines 27. The terminal connecting part 23 includes a bottom wall 29 extending in a longitudinal direction, a pair of side walls 31 raised from both side edges of the bottom wall 29, a ceiling wall 33 continuous from the side wall 31 and opposed to the bottom wall 29 and a resilient contact piece 35 continuous to a side part of the ceiling wall 33 and overlapped on an inner side of the ceiling wall 33.

Namely, the terminal 13 is formed as a female terminal having the resilient contact piece 35 inside the terminal connecting part 23 formed in a box shape which comes into contact with the mate terminal not shown in the drawing. The terminal 13 to which the present invention is applied is not limited to the female terminal and may be a male terminal. Further, in the specification, a fitting side (a left side in FIG. 2) of the terminal 13 to the mate terminal is described as a front part and an opposite side thereto is described as a rear part.

In the one side wall 31, a front protruding piece 39 engaged with a cut-out part 37 formed in the ceiling wall 33 and a rear protruding piece 41 protrude upward. In the other side wall 31, a central protruding piece 43 protrudes upward. To a rear part of the bottom wall 29 in the terminal connecting part 23, the electric wire connecting part 11 is connected.

The electric wire connecting part 11 is connected to the bottom wall 29 and includes a core wire barrel part 45 and an insulating coat barrel part 47 in which the one end 17 of the electric wire 15 is crimped.

The core wire barrel part 45 has one pair of barrel pieces 49 for the core wires which are continuous to the bottom wall 29 and protrude in the direction of width of the bottom wall 29. A part of the core wire barrel part 45 in the longitudinal direction of the terminal is set as a core wire arranging area 51. The one pair of barrel pieces 49 for the core wires are formed continuously to the bottom wall 29 so as to protrude symmetrically in the direction of width of the bottom wall 29. The barrel pieces 49 for the core wires are calked so that the barrel pieces for the core wires are connected to the core wires 21. On a connecting surface of the barrel pieces 49 for the core wires where the core wires 21 are mounted, three recessed parts 53 which tear oxide films formed in the peripheries of the core wires 21 when the core wires 21 are attached under pressure are formed substantially in parallel with the direction of width.

As shown in FIG. 3, the core wire barrel part 45 has bell-mouth parts 55 in end parts in the longitudinal direction of the terminal. The bell-mouth parts 55 serve to separate edges of the barrel pieces 49 for the core wires from the core wires 21 when the core wires 21 are crimped by the barrel pieces 49 for the core wires. Thus, a part of the core wires 21 is prevented from being disconnected or broken due to an abutment of the edges of the barrel pieces 49 for the core wires on the core wires 21 and a tensile strength of a pressure attaching part is prevented from being lowered.

The insulating coat barrel part 47 is continuously formed in a rear part of the core wire barrel part 45 and has one pair of coating barrel pieces 57. The one pair of coating barrel pieces 57 have inclined side parts 59 of the same inclined directions in adjacent side edges. The one pair of coating barrel pieces 57 are arranged to shift in the longitudinal direction of the terminal. The adjacent inclined side parts 59 are crimped in a cylindrical shape so as to correspond to each other. As shown in FIG. 2, in the insulating coat barrel part 47, the one pair of coating barrel pieces 57 are crimped on the one end 17 of the electric wire 15 from an outer side of the insulating coat 19.

In the terminal 13, before the core wire barrel part 45 crimps the core wires 21, the electric wire connecting part 11 is plated with zinc (a third metal) whose ionization tendency is located between the aluminum material (the first metal) and the copper material (the second metal) so as to form a plating layer 61 thereon. The plating layer 61 formed by a plating process is applied to all of the core wire barrel part 45 (including the bell-mouth parts 55) of the core wire arranging area 51 and the insulating coat barrel part 47 (see FIG. 1). The plating layer 61 applied to the connecting surface of the core wire barrel part 45 is broken down except the bell-mouth parts 55 when the core wire barrel part 45 is crimped.

The plating layer 61 is obtained by applying the plating process to a part in which the core wires 21 of the aluminum electric wire come into direct contact with copper alloy when the terminal 13 made of, for instance, the copper alloy is manufactured. For the plating layer 61, zinc having an electric conductivity of a potential lower than that of the aluminum material is applied on the existing plating provided by an ordinary process or on a base metal. Further, the plating layer 61 may be applied by any of methods of a plating (a previous plating) in a stage of the base metal, a plating (an intermediate plating) after a press punching operation and a plating (an after plating) after a product is worked.

Now, an explanation will be given to a corrosion preventing operation in the electric wire connecting part 11 of the terminal 13 having the structure.

In the electric wire connecting part 11 of the terminal 13, the plating layer 61 is applied to all of the core wire barrel part 45 of the core wire arranging area 51 and the insulating coat barrel part 47. The plating layer 61 made of zinc comes into contact with copper or brass and is preferentially easily oxidized to form a stable film. Namely, since the plating layer 61 made of zinc which isolates both conductors from each other is interposed in an exposed part of a boundary of the core wires 21 and the connecting surface of the core wire barrel part 45 which is formed when the core wires 21 are crimped and connected, a connecting state meeting an order of the level of the ionization tendency such as the aluminum material -zinc-the copper material is formed in the exposed part of the boundary. Thus, even when aqueous electrolyte solution such as rain water enters and stays, the plating layer 61 preferentially takes over a contact corrosion of dissimilar metals to prevent the core wires from being corroded. Further, since a part between the pressure-attached core wires 21 and the connecting surface of the core wire barrel part 45 is covered with the plating layer 61 of zinc, an interposing material does not enter so that corrosion does not progress.

Figure 4:
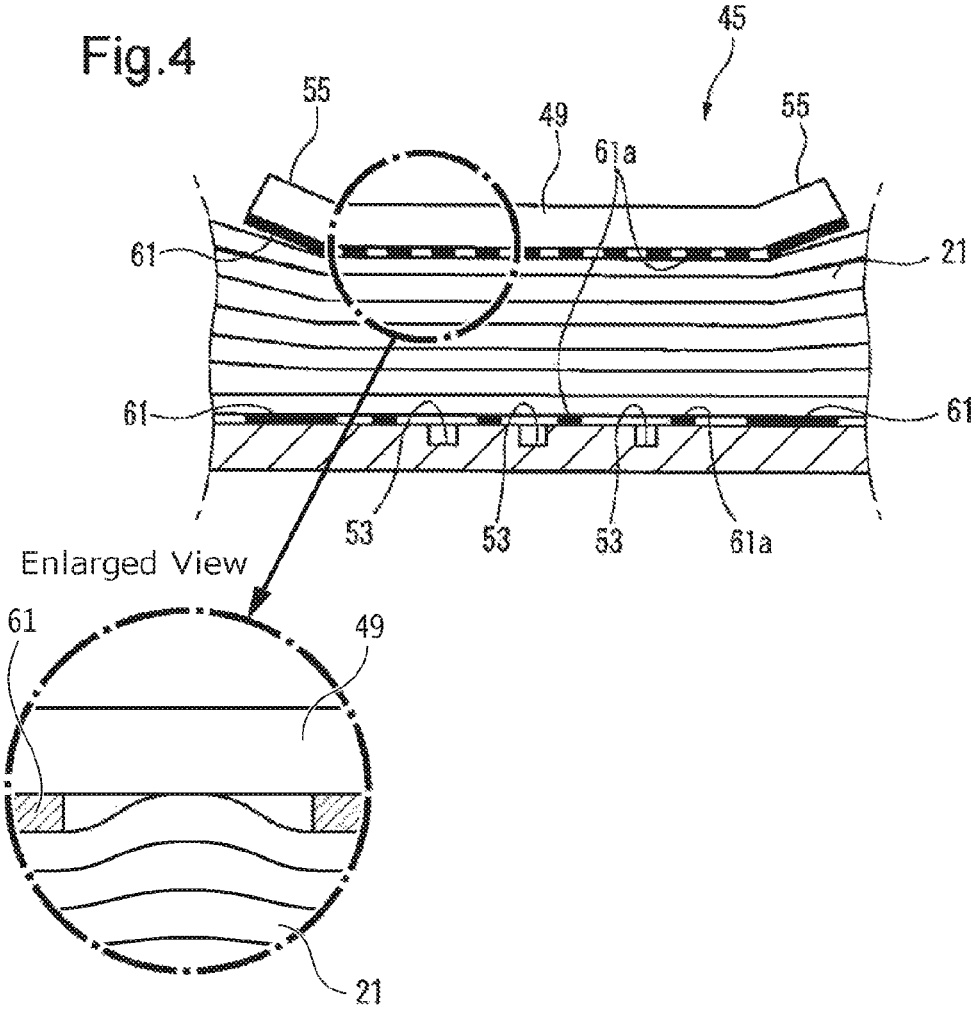
FIG. 4 is a sectional view taken along a line A-A in FIG. 3.
Figure 5:
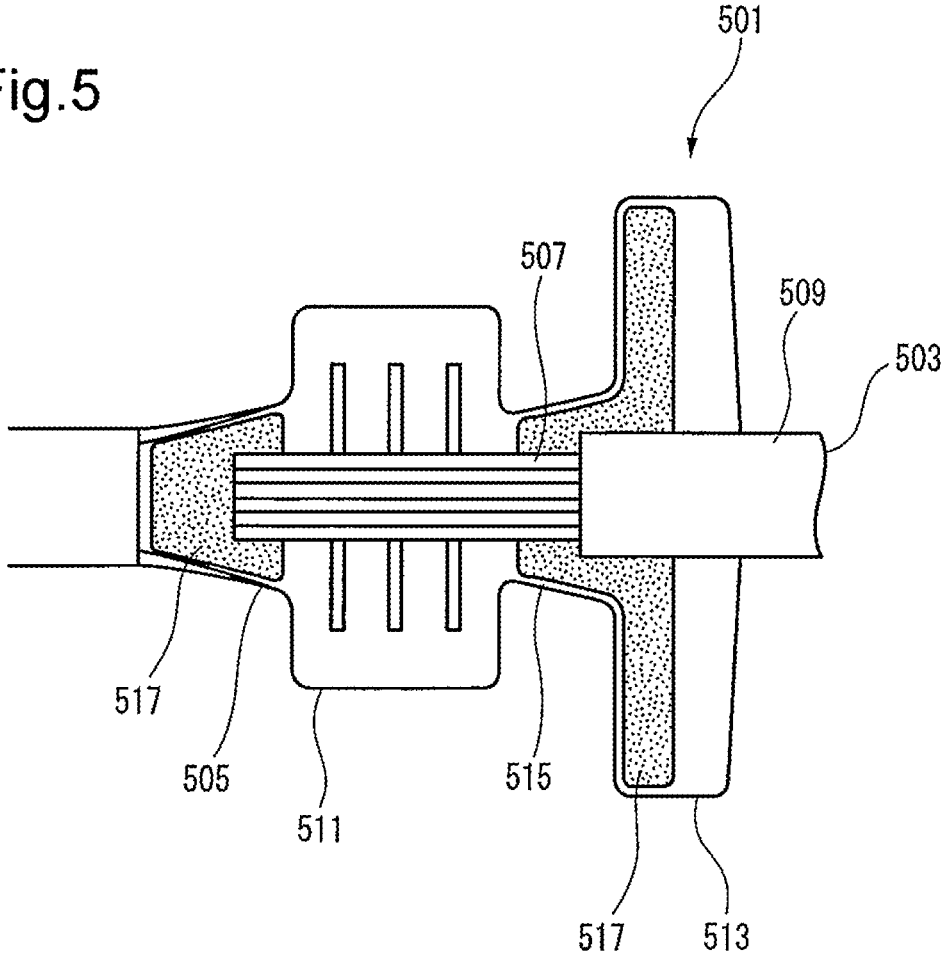
FIG. 5 is a plan view of an expanded state of a usual terminal having a corrosion preventing structure shown together with an electric wire.

The plating layer 61 made of zinc is managed to be formed thin so that the plating layer 61 may be provided in the core wire barrel part 45. Namely, the plating layer 61 is broken down by a pressure attaching operation. Thus, the core wires 21 are electrically conducted to the connecting surface of the core wire barrel part 45. Especially, in the recessed parts 53 of the core wire barrel part 45, a break-down is accelerated due to a concentration of stress. Thus, a contact area is largely ensured. This break-down can be achieved by adding a deformation amount by crimping which is the same as the thickness of the plating layer 61 or larger. Further, very small pieces 61*a* (see FIG. 4) of the broken down plating layer 61 are interposed between the core wires 21 and the connecting surface of the core wire barrel part 45. However, since the plating layer 61 of the present exemplary embodiment is made of zinc, such a rise of a resistance value as to exceed an ordinary standard does not arise.

Accordingly, in the terminal 13, a process is not necessary for masking an insulator which increases the resistance value so as not to spread the insulator to the electric wire connecting part as in the usual structure. Thus, a range to which the plating process is applied is easily managed. Then, since a process and a management are easily carried out in the same process (a plating line), which is different from the application of the insulator after a product is manufactured, the corrosion preventing operation can be more inexpensively achieved.

Further, in the plating layer 61 of the connecting surface in the bell-mouth parts 55, a deformation due to a crimping operation is smaller than a deformation in other crimped part. Thus, the plating layer 61 in the bell-mouth parts 55 is not broken down and left during the crimping operation. Accordingly, the corrosion of the exposed part of the boundary is more assuredly prevented.

Accordingly, in the terminal 13 according to the present exemplary embodiment, the terminal 13 can be provided which prevents the contact corrosion of the dissimilar metals between the core wires 21 and the terminal 13 made of the dissimilar metals of the aluminum material and the copper material and simplifies an operating process more than the application of the insulator after the production.

The terminal of the present invention is not limited to the exemplary embodiment and may be suitably modified and improved. In addition thereto, materials, forms, dimensions and arranged positions of component elements in the exemplary embodiment are arbitrarily used, as long as they can achieve the present invention.

The present application is based on Japanese Patent Application No. 2011-284265 filed on Dec. 26, 2011, the contents of which are incorporated herein by reference.

INDUSTRIAL APPLICABILITY

According to the terminal of the present invention, a terminal can be prevented which prevents a contact corrosion of dissimilar metals between a core wire and a terminal made of the dissimilar metals and simplifies an operating process more than an application of an insulator after a production.

REFERENCE SIGNS LIST

11 . . . electric wire connecting part
13 . . . terminal
15 . . . electric wire
17 . . . one end
21 . . . core wire
45 . . . core wire barrel part
55 . . . bell-mouth part
61 . . . plating layer

The invention claimed is:

1. A terminal, comprising:

an electric wire connecting part having a core wire barrel part that crimps a core wire exposed in one end of an electric wire, the core wire being made of a first metal;

wherein the electric wire connecting part is made of a second metal whose ionization tendency is lower than that of the first metal, wherein the electric wire connecting part is plated with a third metal whose ionization tendency is between the first metal and the second metal so that a plating layer made of the third metal is formed on the electric wire connecting part, and wherein the core wire barrel part is crimped so as to break down the plating layer formed on a connecting surface of the core wire barrel part on which the core wire is mounted, wherein the core wire and the connecting surface of the core wire barrel part are in contact directly and electrically with each other.

2. The terminal according to claim 1, wherein an end part of the core wire barrel part in a longitudinal direction of the terminal is provided with a bell-mouth part.

3. The terminal according to claim 1, wherein the third metal comprises zinc.

4. The terminal according to claim 1, wherein very small pieces of a broken down plating layer are partially located between the core wire and the connecting surface of the core wire.

* * * * *